United States Patent [19]

Asano

[11] 4,121,385

[45] Oct. 24, 1978

[54] CAM GRINDING MACHINE

[75] Inventor: Hiroaki Asano, Chiryu, Japan

[73] Assignee: Toyoda-Koki Kabushiki-Kaisha, Tokyo, Japan

[21] Appl. No.: 810,804

[22] Filed: Jun. 28, 1977

[30] Foreign Application Priority Data

Aug. 12, 1976 [JP] Japan ..... 51-95352

[51] Int. Cl.[2] ..... B24B 5/42; B24B 17/02

[52] U.S. Cl. ..... 51/101 R; 51/237 CS

[58] Field of Search ..... 51/97 R, 97 NC, 101 R, 51/234, 237 R, 237 CS; 82/9, 40 A

[56] References Cited

U.S. PATENT DOCUMENTS

| | | | |
|---|---|---|---|
| 2,508,998 | 5/1950 | Green | 51/101 R |
| 2,641,874 | 6/1953 | Kirby | 51/101 R |
| 2,801,505 | 8/1957 | Comstock | 51/101 R X |
| 3,468,069 | 9/1969 | Fries | 51/101 R |
| 3,621,614 | 11/1971 | Hikita | 51/101 R |

*Primary Examiner*—N. P. Godici

*Attorney, Agent, or Firm*—Oblon, Fisher, Spivak, McClelland & Maier

[57] ABSTRACT

A headstock for a cam grinding machine comprising a headstock housing for housing a work spindle rotatably supported on a rocking table which is urged by means of springs to be pivoted so as to contact master cams carried on the work spindle with a follower roller. The headstock housing is provided with a pair of spaced through bores co-axially extending in parallel relation with the work spindle. A follower support assembly and a wheel support assembly are held in engagement with the bores in the headstock housing in a manner of selective use, so that the follower roller and a master cam grinding wheel are selectively supported with the same support reference, to be rotatable about the axis of the bores.

7 Claims, 4 Drawing Figures

3
10
9
53
2
8
22
47b
56
55
54
31
60
59
7a
33
50a
7b
16
15
35
57
50
310
1
320
7
12
13
37
40
47
14
6
47a
32
49
8
50
31
M2
23
11
M1
51
52

CAM GRINDING MACHINE

BACKGROUND OF THE INVENTION

1. Field of the Invention

This invention relates generally to cam grinding machines for grinding automotive cam shafts or the like, and, more particularly, to such machines being capable of grinding, in accordance with a model cam, master cams which are bodily carried on a work spindle rotatably supported upon a rocking table.

2. Description of the Prior Art

In a typical headstock of a cam grinding machine having been in use heretofore, a dovetail guide way is formed parallel to a work spindle bodily carrying master cams, and a slider, slidably guided by the guide way, is provided with a rotational spindle rotatably supported at such a position as to be overhung far from the guide way toward the work spindle, the rotational spindle supporting at one end thereof a master cam grinding wheel with a small diameter. Because of the overhang disposition of the rotational spindle, however, the headstock is liable to lack in rigidity and does not provide completely satisfactory master cam grinding accuracy.

Furthermore, the headstock is correlated to a follower roller support mechanism and, for the purpose of pivotal movement of a rocking table carrying the work spindle, a follower roller having the same diameter as the master cam grinding wheel is fitted upon the rotational spindle of the slider guided by the dllower roller, and this further invites deterioration in the accuracy of ground workpiece cams.

SUMMARY OF THE INVENTION

It is therefore an object of the present invention to provide an improved cam grinding machine having high support rigidity of a master cam grinding wheel and thus being capable of grinding master cams with superior accuracy or precision.

Another object of the invention is to provide an improved cam grinding machine wherein a support reference for a master cam grinding wheel coincides with the rotational axis thereof.

A further object of the invention is to provide an improved cam grinding machine wherein a master cam grinding wheel and a follower roller are supported, in a manner of selective use, using a common support reference coinciding with their rotational axes.

Briefly, according to the present invention, there is provided a cam grinding machine, which comprises a rocking table supported on a traverse table to be pivotable about a pivot shaft, a work spindle rotatably carried on the rocking table parallel with the pivot shaft for supporting master cams and adapted to selectively support at one end thereof a model cam or a workpiece cam, and urging means for urging the rocking table to be pivoted so as to contact the master cams with a follower roller.

The machine further comprises a headstock housing for the work spindle, in which housing a pair of spaced through bores are formed co-axially extending parallel with the work spindle. A follower support assembly and a wheel support assembly are further provided to be held in engagement with the headstock housing bores in a manner of selective use, so that the follower roller and a master cam grinding wheel are selectively supported with the same support reference, to be rotatable about the axis of the bores.

BRIEF DESCRIPTION OF THE DRAWINGS

Various other objects, features and attendant advantages of the present invention will be more fully appreciated as the same becomes better understood by reference to the following detailed description of the preferred embodiment, when considered together with the accompanying drawings, in which.

DETAILED DESCRIPTION OF A PREFERRED EMBODIMENT

Figure 1:
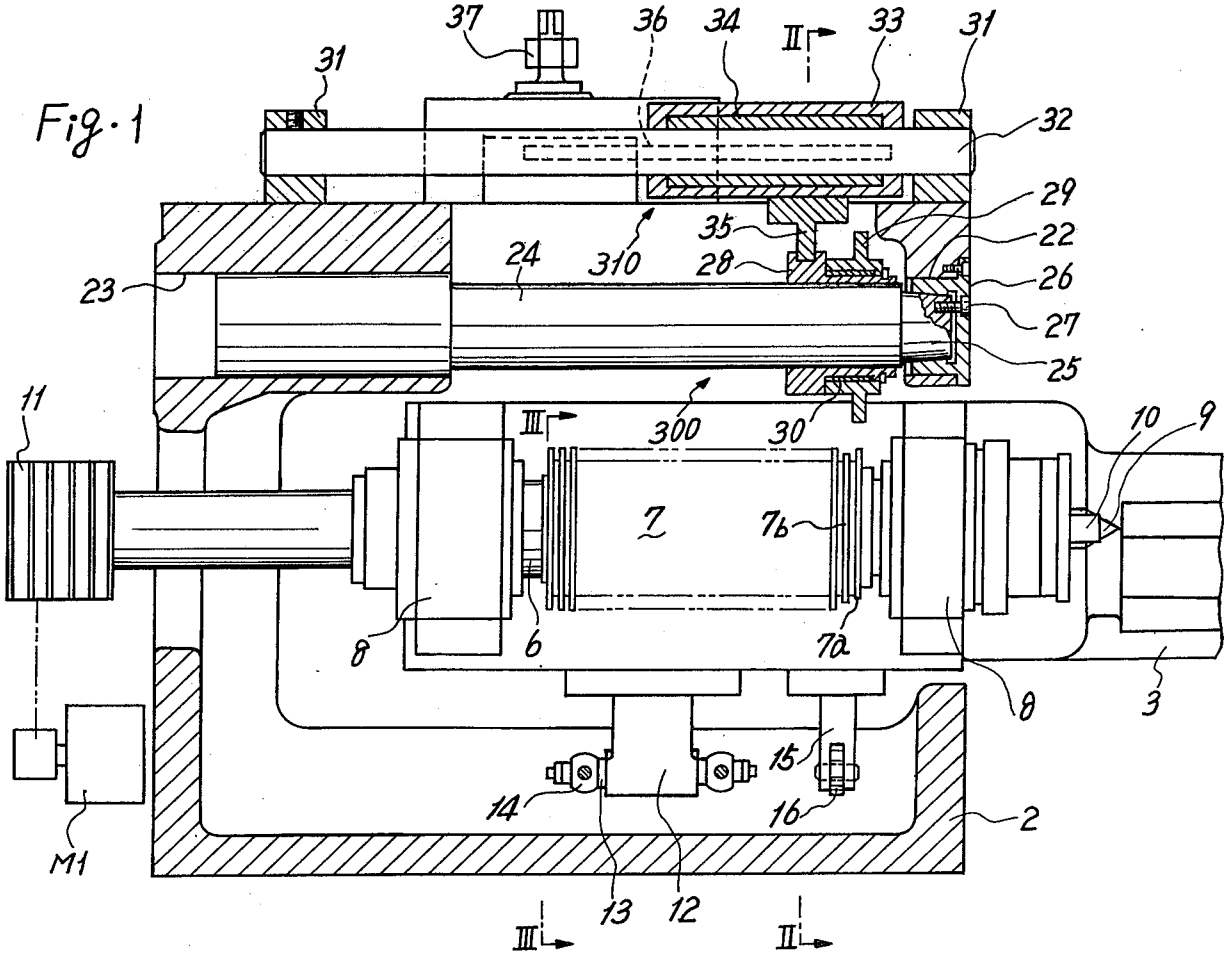
FIG. 1 is a horizontal sectional view of a headstock for a cam grinding machine according to the present invention, showing a condition of the headstock incorporating a follower support assembly.
Figure 2:
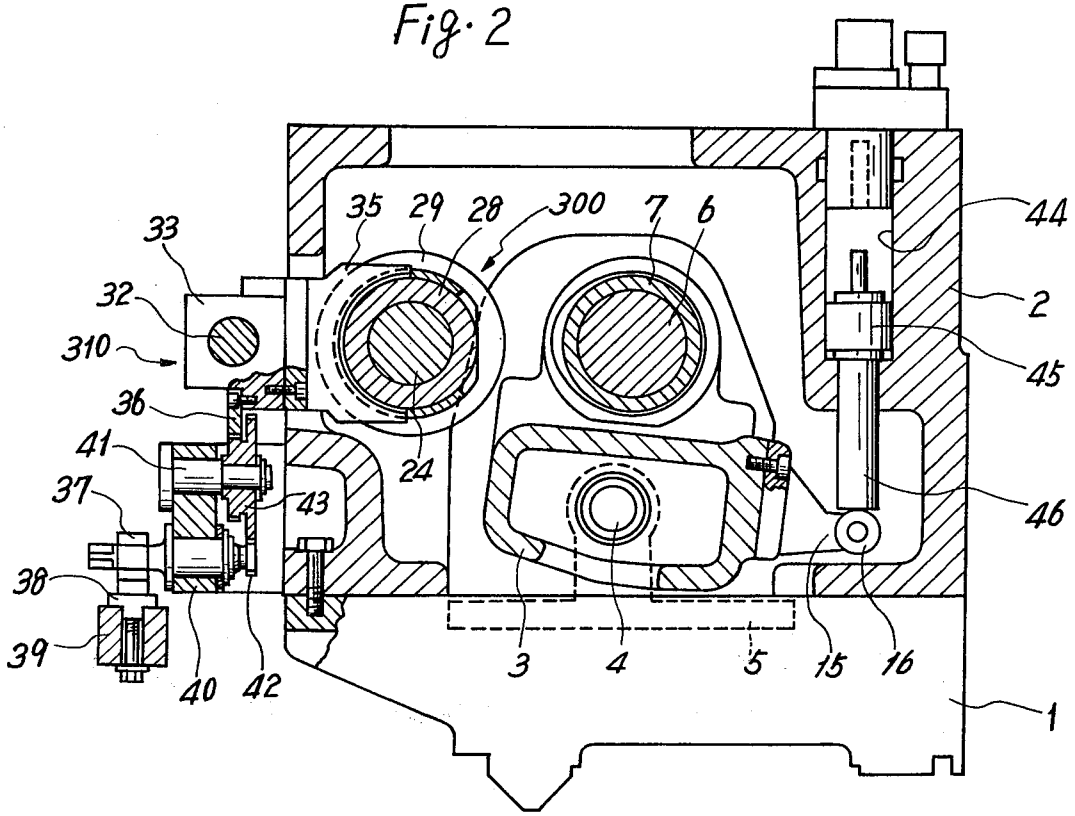
FIG. 2 is a sectional view of the apparatus taken along the line II—II of FIG. 1.

Referring to the drawings, wherein like reference numerals designate like or corresponding parts throughout the several views, and particularly to FIGS. 1 and 2 thereof, a traverse table 1 is mounted on a bed, not shown, for traverse movement and has thereon a rocking table 3 being pivotably mounted through a pivot shaft 4. The pivot shaft 4 is supported by a bearing bracket 5 fixed upon the traverse table 1. Upon the rocking table 3, a work spindle 6 is rotatably carried, extending parallel with the axis of the pivot shaft 4. The reference numeral 8 denotes a pair of detachable bearing caps supporting the work spindle 6 on the rocking table 3. A plurality of master cams 7 are keyed on the work spindle 6 between the bearing caps 8. At one end of the work spindle 6, being the right end as viewed in FIG. 1, there are provided a headstock center 9 and a driving protrusion 10, the former of which, in cooperation with a footstock center, not shown, supports an automotive cam shaft in workpiece grinding and a model cam in master cam grinding. At the other, or the left end of the work spindle 6, a work spindle pulley 11 is keyed for transmitting rotation from an electric motor M1 mounted upon a headstock housing 2, which is fixed upon the traverse table 1 to house the work spindle 6 and its associated parts.

Figure 3:
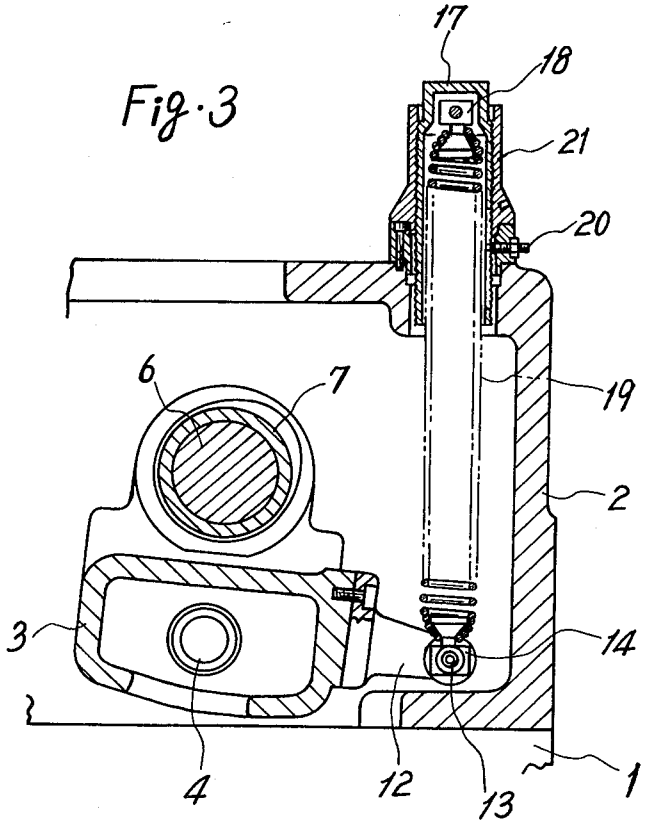
FIG. 3 is a sectional view of the apparatus taken along the line III—III of FIG. 1.

Protruding from the rocking table 3 is a spring bracket 12, by which a pair of spring shoes 14 are pivotably carried through a pivot pin 13. Into the headstock housing 2, immediately above the spring shoes 14, there is inserted a screw sleeve 17 which, as shown in FIG. 3, is restrained by a guide bolt 20 from rotation, but is allowed axial movement. A nut 21 is threadedly engaged with the outer periphery of the screw sleeve 17 and, when rotated, serves to vertically displace the same. The screw sleeve 17 has another pair of spring shoes 18 hinged therewithin, through a pin, not numbered, and tension springs 19 are interposed between the respective shoes 14 and 18. Accordingly, the rocking table 3 is urged by the tension springs 19 to be pivoted in such a direction as to make the master cams 7 come into contact with a follower roller 29, or a master cam grinding wheel, 59, which will be referred to in detail later, and contact pressure therebetween is adjustable by means of the nut 21.

The rocking table 3 further has protruding therefrom, in parallel relation with the spring bracket 12, a roller bracket 15, which rotatably supports a roller 16 at is remote end. This roller 16, as best shown in FIG. 2, is in contact with one end of a piston rod 46 of a piston 45, which is slidably contained within a vertically disposed cylinder 44 provided in the headstock housing 2 for anti-spring pivot movement of the rocking table 3.

Furthermore, in right and left walls of the headstock housing 2, there are formed a pair of spaced through bores 22 and 23, which are disposed in co-axial alignment with each other and in parallel relation with the axis of the work spindle 6. Into the through bores 22 and 23, pilot bars 24 and 47, the latter which will be described later, are removably insertable in a manner of selective use for respectively supporting the follower roller 29 and the master cam grinding wheel 59. FIG. 1 shows a condition wherein a follower support attachment or assembly, generally indicated at 300, is held in engagement within the bores 22 and 23. The assembly 300 includes the follower pilot bar 24, whose frusto-conical one end 25 is held by the bore 22 through a bore cap 26, while the other straight end is snugly received in the bore 23. The bore cap 26 is fixedly received in the bore 22, and a drawing bolt 27 is provided to draw the one end 25 of the pilot bar 24 toward the right so as thereby to tightly fit the same within the bore cap 26 in the form of a tapered engagement. Slidably guided on the pilot bar 24 is a follower slider 28, by which the follower roller 29 is rotatably supported, through a bearing 30, in co-axial alignment with the pilot bar 24.

In order to shift the follower roller 29, a shift device, generally indicated at 310, is provided, comprising support blocks 31 and 31, which are fixed upon the rear wall of the headstock housing 2 at a predetermined spacing. A shifter pilot bar 32 is received at both ends thereof in the support blocks 31 and 31 and is disposed in parallel relation with the follower pilot bar 24 held by the bores 22 and 23. A shifter 33 is slidably disposed on the shifter pilot bar 32, through a bearing 34. This shifter 33 has a shift lever 35 integrally protruding therefrom, which is maintained engaged with the follower slider 28 carrying the follower roller 29. To the under side of the shifter 33, a rack 36 is secured in parallel relation with the shifter pilot bar 32 and is engaged with a reduction gear 43, which is rotatably carried through a stationary stub shaft 41 by a support bracket 40 fixed upon the headstock housing 2. The reduction gear 43 is engaged also with a pinion 42, which is carried by the support bracket 40 to be rotatable integrally with a star gear or a star gear shaft 37. Disposed upon the bed, not shown, is a stationary dog rail 39, which is extended in the same direction as the sliding movement of the traverse table 1, and on and along which a train of dogs 38 are secured. These dogs 38 are so spaced with one another as to engage and intermittently rotate the star gear 37 when the traverse table 1 is caused to slide. It is therefore understood that the star gear 37, when rotated, serves to shift the shifter 33 a predetermined amount through the pinion 42, the reduction gear 43, and the rack 36, so as to thereby cause the shift lever 35 to slide the follower roller 29 corresponding to the pitch between one and the next of the master cams 7.

Figure 4:
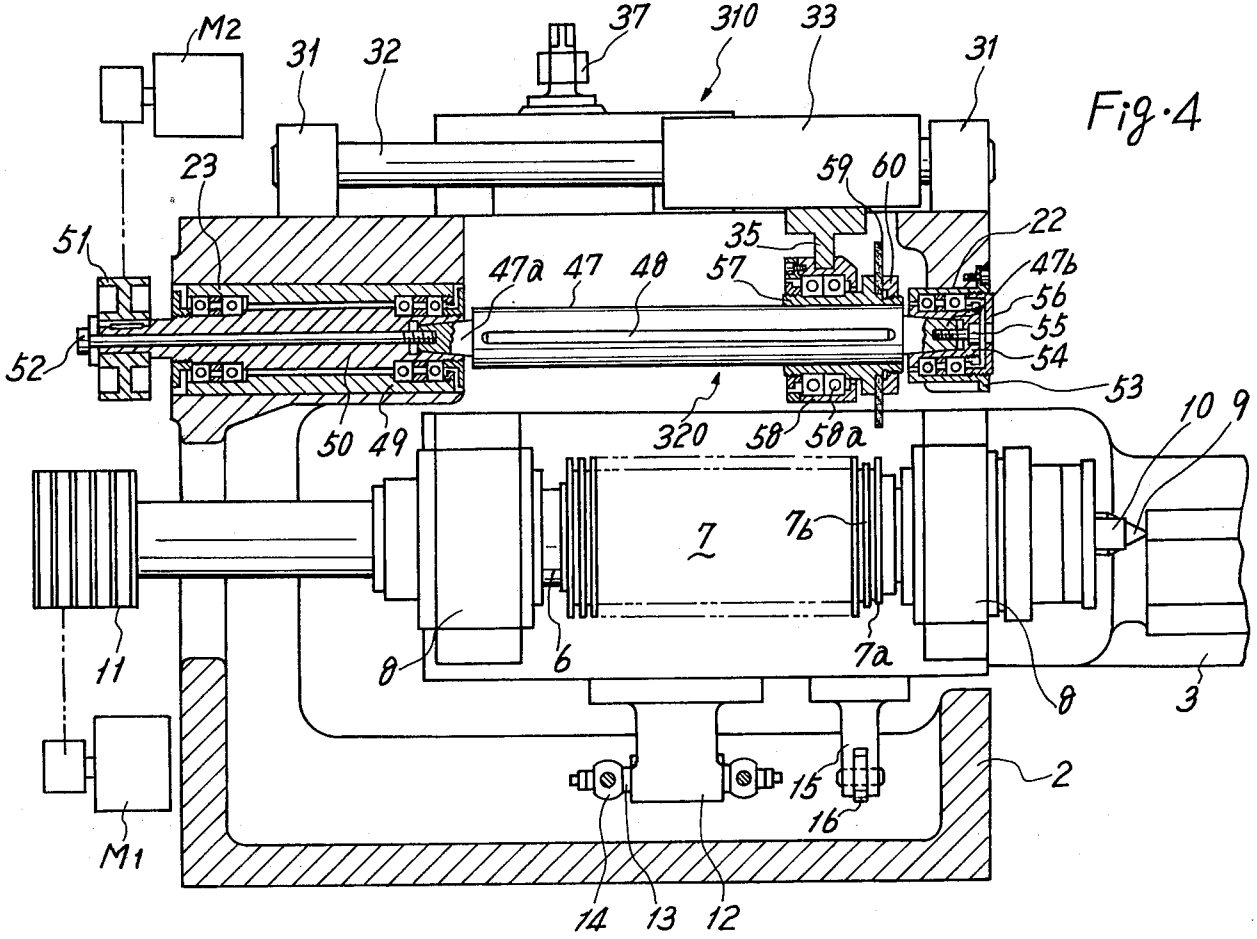
FIG. 4 is the same view as FIG. 1, showing, however, another arrangement of the apparatus incorporating a wheel support assembly.

FIG. 4 shows another arrangement, for master cam grinding, wherein a wheel support attachment or assembly, generally indicated at 320, is held in engagement with the through bores 22 and 23, in lieu of the aforementioned follower support assembly 300. This wheel support assembly 320 comprises a wheel pilot bar 47, on which a bar key 48 is fixed therealong. A wheel slider 57, having the master cam grinding wheel 59 secured thereon by means of a tightening flange 60, slidably rides on the pilot bar 47, in engagement with the bar key 48. A shift sleeve 58 is relatively rotatably mounted upon the wheel slider 57 through bearings **58*a* and is so engaged with the above-noted shift lever 35 as to shift the grinding wheel 59, based upon the intermittent rotation of the star gear 37**, in the same manner as mentioned previously.

In order to transmit to the grinding wheel 59 the rotation of a wheel pulley 51, driven by another electric motor M2, the wheel pilot bar 47 is rotatably supported within the bores 22 and 23. Specifically, into perforation bores 22 and 23 are respectively removably inserted the bearing housings 49 and 53, within which rotational sleeves 50 and 54 are respectively rotatably supported through bearings, not numbered. The wheel pilot bar 47 is carried by the rotational sleeves 50 and 54, with their frusto-conical ends **47*a* and 47*b* being inserted thereinto, in tapered engagement, and being tightly connected thereby by means of tightening bolts 52 and 55, respectively. A bearing cap is designated by a reference numeral 56 in FIG. 4**.

The operation of the apparatus, as constructed above, will be described hereunder. For the purpose of and prior to workpiece cam grinding, the follower pilot bar 24 is inserted from the left, as viewed in FIG. 1, into the bore 23 and, after passing through the follower slider 28, also into the bore cap 26, wherein it is fixed thereto by means of the tightening bolt 27. With subsequent upward movement of the piston 45, the rocking table 3 is pivoted by means of the tension springs 19 in the counterclockwise direction, as viewed in FIG. 2, and the first master cam **7*a* comes into contact with the follower roller 29. In this event, the contact pressure therebetween is adjusted to a desired value by rotationally manipulating the unit 21, which effects vertical movement of the screw sleeve 17 to thereby vary the tension force of the tension springs 19. Upon completion of such adjustment, the workpiece cams or, to be more exact, an automotive cam shaft is loaded between the headstock center 9 and the footstock center. Then, with rotational drive of the work spindle 6, the rocking table 3 is pivotably moved, together with the work spindle 6, on the traces of the profile of the first master cam 7*a***, so that a first cam of the cam shaft is ground to an intended profile with a working grinding wheel carried on a wheel head, both not shown, being now in-fed, as is well known in the art.

The shifting operation of the follower roller 29 is as follows: The traverse table 1 is moved a predetermined distance toward the right, as viewed in FIG. 1, in a usual manner, and this effect the intermittent rotation of the star gear 37, because the same is engaged with one of the dogs 38. This rotation is transmitted through the reduction gear 43 and the rack 36 to the shifter 33 as straight movement, whose shift lever 35 thus shifts the follower slider 28 along the pilot bar 24 through such a distance as to face or align the follower roller 29 to another or a second master cam **7*b* of the cams 7. It is herein to be noted that the grinding wheel of the wheel head in this time has been aligned with a second cam on the cam shaft, for which the grinding operation will be effected subsequently. It is further to be noted that the foregoing shift operation is in fact initiated after the wheel head is retracted and after the rocking table 3 is pivoted in the clockwise direction, as viewed in FIG. 2, with downward movement of the piston 45**.

On the necessity of master cam grinding, the follower support bar 24 and the bore cap 26 are removed from support by the bores 22 and 23, and in substitution therefor, the bearing housings 49 and 53 are inserted, respectively, into the bores 22 and 23, as shown in FIG. 4, the bearing housing 53 being then fixed to the headstock housing 2 by means of a bolt, not numbered. It is herein to be understood that the wheel pilot bar 47 is always reserved in such a condition as to have been assembled with the bearing housing 53. For the purpose of disposition within the headstock housing 2, the wheel pilot bar 47 is passed through the bore 22 and then is inserted into the wheel slider 57. The rotational sleeve 50 is thereafter engaged with one of the frusto-conical ends 47*a* and is secured thereto by means of the tightening bolt 52. Furthermore, operations are performed to support a model cam, not shown, between the headstock center 9 and the footstock center and to mount on a wheel spindle of the wheel head a master disc, not shown, which has the same diameter as the grinding wheel removed therefrom, as is well known in the art. It is, of course, noted that a master cam blank with a plurality of master cams to be ground is mounted upon the work spindle 6.

After these preparatory operations, the wheel head is advanced to such a position that, when the rocking table 3 is subsequently pivoted in the counterclockwise direction, as viewed in FIG. 2, with upward movement of the piston 45, contact between the master disc and the model cam effects no contact between the master cam blank and the master grinding wheel 59. Thereafter, the work spindle 6 and the master grinding wheel 59 are driven upon receipt of rotation from the pulleys 11 and 51, respectively. Since the model cam is rotated as it contacts the master disc, the rocking table 3 is pivoted in accordance with the profile of the model cam. Accordingly, when the wheel head is retracted, one of the master cams is contacted with the master grinding wheel 59 to be ground thereby to a profile corresponding to the model cam. It is noted that shifting operation of the master grinding wheel 59 is carried out in such a way as to manually rotate the star gear 37, using, for example, a wrench. Upon completion of grinding all of the master cams, the wheel pilot bar 47 and the bearing housings 49 and 53 are removed from support by the bores 22 and 23, and the follower roller 29 is again supported therat, as shown in FIG. 1.

As mentioned previously, in the apparatus of this invention, the master grinding wheel and the follower roller are mountable upon the respective pilot bars which are held with the same support reference by the spaced bores co-axially formed on the headstock housing. According to the present invention, therefore, support rigidity of the master grinding wheel, as well as the follower roller, can be heightened, and the master cams can be ground with desired precision corresponding to the model cam. As the accuracy of the model cam is better reflected upon workpiece cams, precise cam grinding can further be attained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a cam grinding machine having a rocking table pivotably mounted upon a traverse table through a pivot shaft, a work spindle rotatably supported upon said rocking table in parallel relation with said pivot shaft and having a plurality of master cams fixedly carried thereon, one end of said work spindle being adapted to selectively support a cam shaft or a model cam, means for urging said rocking table to pivot so as to contact said master cams with a follower roller, and first and second drive means for respectively rotating said work spindle and a master grinding wheel, the improvement of which comprises:

a headstock housing fixed on said transverse table for housing said work spindle and formed with a pair of co-axial spaced through bores extending in parallel relation with said work spindle;

a follower pilot bar capable of being removably held at both ends thereof in engagement with said through bores;

a follower slider slidably guided by said follower pilot bar in a removable manner and rotatably supporting said follower roller in co-axial alignment with said follower pilot bar;

a pair of bearing housings being respectively removably receivable in said through bores;

rotational sleeves respectively rotatably supported within said bearing housings, one of said rotational sleeves being drivingly connectable with said second drive means;

a wheel pilot bar disconnectably received at both ends thereof within said rotational sleeves in axial alignment with said through bores;

a wheel slider guided by said wheel pilot bar in a removable manner and carrying said master grinding wheel for rotation together therewith about said wheel pilot bar; and shift means selectively engageable with said follower slider or said wheel slider for shifting any one in use of said follower roller and said master grinding wheel on the axis of said through bores;

said follower pilot bar and said pair of said bearing housings being selectively received within said through bores.

2. A cam grinding machine as claimed in claim 1, wherein said wheel pilot bar has frusto-conical ends respectively receivable in said rotational sleeves to be connected thereto in tapered engagement.

3. A cam grinding machine as claimed in claim 2, wherein a shift sleeve is further provided being relatively rotatably supported upon said wheel slider, and wherein said shift means is engageable with any one in use of said follower slider and said shift sleeve.

4. A cam grinding machine as claimed in claim 3, wherein said shift means comprises:

a shifter pilot bar disposed upon said headstock housing in parallel with said work spindle;

a shifter slidably guided by said shifter pilot bar and being engageable with any one in use of said follower slider and said shift sleeve;

a star gear shaft rotatably carried on said headstock housing;

a rack and pinion mechanism arranged between said shifter and said star gear shaft; and a train of dogs stationarily disposed to intermittently rotate and star gear shaft in engagement therewith when said traverse table is moved.

5. A cam grinding machine as claimed in claim 4, further comprising an actuator for pivotably moving said rocking table against the force of said urging means.

6. A cam grinding machine as claimed in claim 1, wherein said shift means comprises:

a shifter pilot bar disposed upon said headstock housing in parallel relation with said work spindle;

a shifter slidably guided by said shifter pilot bar and being engageable with any one in use of said follower slider and said shift sleeve;

a star gear shaft rotatably carried on said headstock housing;

a rack and pinion mechanism arranged between shifter and said star gear shaft; and a train of dogs stationarily disposed to intermittently rotate said star gear shaft in engagement therewith when said transverse table is moved.

7. A cam grinding machine as claimed in claim 6, further comprising an actuator for pivotably moving said rocking table against the force of said urging means.

* * * * *